US008196307B2

(12) United States Patent
Kägi et al.

(10) Patent No.: US 8,196,307 B2
(45) Date of Patent: Jun. 12, 2012

(54) REGISTER INSERTION APPARATUS

(75) Inventors: Beat Kägi, Bichwil (CH); Urs Brühwiler, Wilen bei Wil (CH); Bozidar Markovic, Gossau (CH)

(73) Assignee: Gietz AG, Gossau (CH)

( * ) Notice: Subject to any disclaimer, the term of this patent is extended or adjusted under 35 U.S.C. 154(b) by 534 days.

(21) Appl. No.: 12/439,166

(22) PCT Filed: Aug. 30, 2007

(86) PCT No.: PCT/CH2007/000430

§ 371 (c)(1),
(2), (4) Date: Jun. 15, 2009

(87) PCT Pub. No.: WO2008/028309

PCT Pub. Date: Mar. 13, 2008

(65) Prior Publication Data

US 2010/0148428 A1 Jun. 17, 2010

(30) Foreign Application Priority Data

Sep. 3, 2006 (CH) ..... 1409/06

(51) Int. Cl.

| | |
|---|---|
| ***B65H 9/10*** | (2006.01) |
| ***B65H 29/04*** | (2006.01) |
| ***B65H 5/08*** | (2006.01) |
| ***B65H 11/00*** | (2006.01) |

(52) U.S. Cl. ..... 33/623

(58) Field of Classification Search ..... 33/623, 33/613; 271/226, 227, 228, 234, 235, 236, 271/239, 241, 248, 249

See application file for complete search history.

(56) References Cited

U.S. PATENT DOCUMENTS 4,380,956 A * 4/1983 Elworthy ..... 101/401.1

(Continued)

FOREIGN PATENT DOCUMENTS

DE 2520232 11/1976

(Continued)

OTHER PUBLICATIONS

International search report for international application No. PCT/CH07/00430.

(Continued)

*Primary Examiner* — Christopher Fulton

(74) *Attorney, Agent, or Firm* — Oppedahl Patent Law Firm LLC

(57) ABSTRACT

The register insertion apparatus for sheet-fed embossing machines with position sensors (S1, S2, S3) for detecting printing marks (P1, P2, P3) of a sheet (5), comprises a register plate (15) capable of being pivoted down as feeder table with ventilation openings (20) and vacuum feed lines (21) to a suction apparatus (22) and front stops (12), which are capable of being lowered and actuators (L1, L2, L3) for positioning the register plate in X-direction and in Y-direction. With a register controller (11) the register plate (15) is pivoted down, a gripper bar (8) is brought up to it, the register plate pivoted up again, then a sheet (5) is fed-in and stopped at the front stops (12). Thereupon the register plate is evacuated for sucking on and fixing the sheet on the register plate. Then the positions of the printing marks (P1, P2, P3) are detected by the position sensors, from this the register correction values (X1, X2, Y3) are calculated and the register plate by means of the actuators (L1, L2) in X-direction and by means of the actuator (L3) in Y-direction is moved into the desired position (P1S, P2S, P3S). Then the sheet is gripped by the gripper bar, the register plate (15) is ventilated and the sheet is transported on by the gripper bar. This results in an automatic register correction at high machine speeds and with the highest print quality.

27 Claims, 6 Drawing Sheets

U.S. PATENT DOCUMENTS

Figure 1:
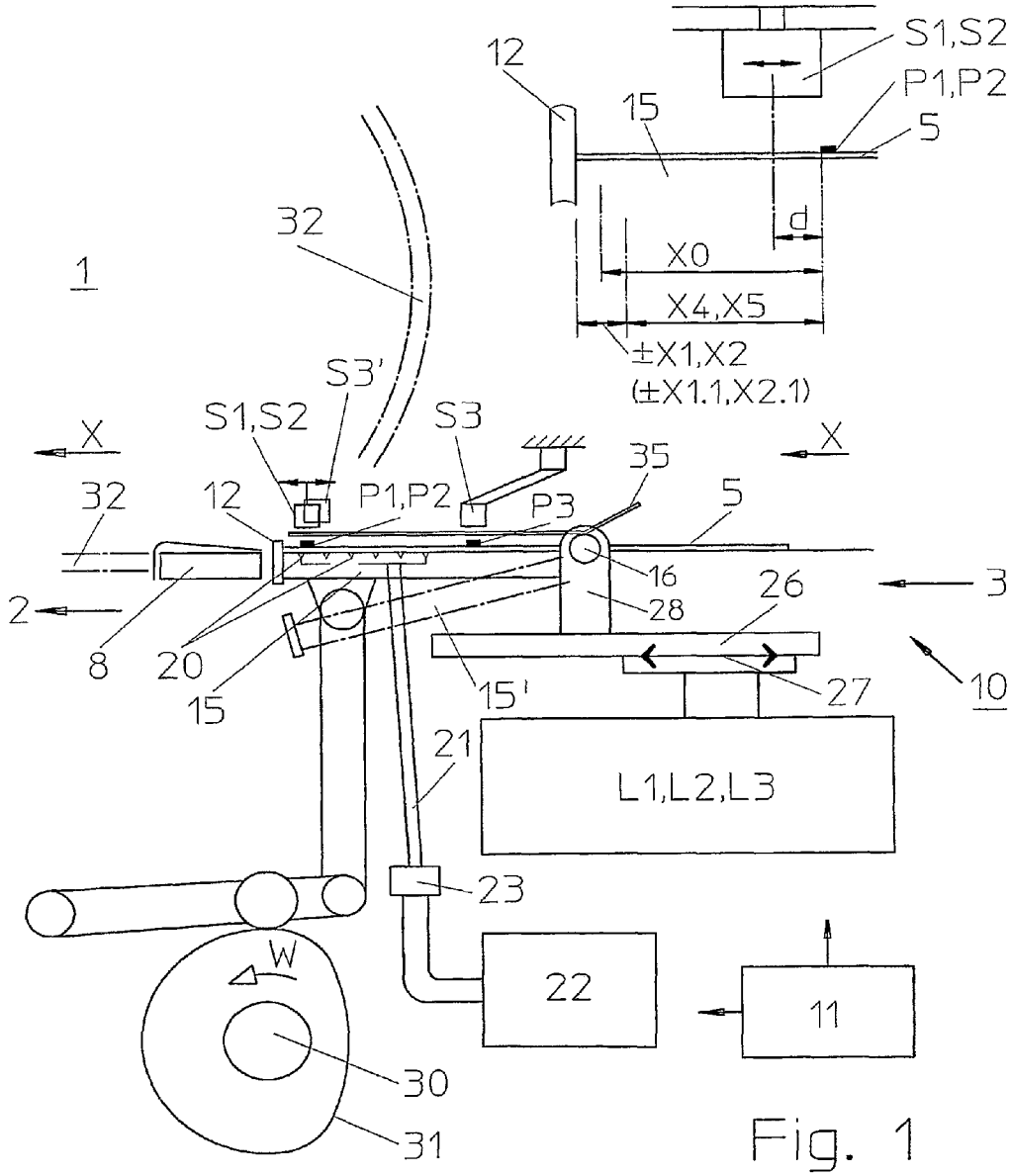

| | | | | |
|---|---|---|---|---|
| 4,426,152 | A * | 1/1984 | Sakamoto et al. | 355/75 |
| 4,785,733 | A * | 11/1988 | Hartung et al. | 101/181 |
| 4,858,528 | A * | 8/1989 | Inouye et al. | 101/175 |
| 5,718,057 | A * | 2/1998 | Rosli et al. | 33/617 |
| 6,505,831 | B2 * | 1/2003 | Henn et al. | 271/227 |
| 6,533,268 | B2 * | 3/2003 | Williams et al. | 271/228 |
| 6,637,634 | B1 * | 10/2003 | Yeo et al. | 226/42 |
| 7,422,211 | B2 * | 9/2008 | Dejong et al. | 271/249 |
| 8,047,537 | B2 * | 11/2011 | dejong et al. | 271/228 |

FOREIGN PATENT DOCUMENTS

| | | |
|---|---|---|
| DE | 19804120 | 8/1999 |
| DE | 10116980 | 11/2001 |
| DE | 10224374 | 12/2003 |
| EP | 0708046 | 4/1996 |

OTHER PUBLICATIONS

Written opinion for international application No. PCT/CH07/00430.

* cited by examiner

REGISTER INSERTION APPARATUS

The invention is related to a register insertion apparatus for sheet-fed embossing machines. An automatic register insertion apparatus or register draw-in device of this kind is, e.g., known from EP 0 708 046, corresponding to U.S. Pat. No. 5,718,057.

Here a not fixed sheet is moved to a desired position by means of position sensors and printing marks controlled by two front stops and a lateral stop, each of which is moved by actuators. This register positioning of a not fixed sheet by means of front—and lateral stops, however, still comprises significant limitations and disadvantages. Above all in the case of higher speeds it is possible that the register movements on a not fixed sheet are not carried out sufficiently rapidly and precisely, because the sheet is increasingly distorted, or upset.

Up until now the register positioning of the sheets therefore normally was adjusted and reset manually. A flat bed embossing machine of this kind is described, e.g., in EP 0 858 888.

Therefore it is the objective of the invention to create an automatic register insertion apparatus for higher performance capacities, which overcomes the current disadvantages and with which for each sheet individually optimally and automatically all register errors are corrected and which enables print- and relief images in a constant highest quality.

This objective is achieved by a register insertion apparatus in accordance with one embodiment of the invention where a register insertion apparatus for sheet embossing machines for use with a sheet having printing marks defining a front edge and a lateral edge of a print image, the sheet movable along an insertion path, said apparatus comprises: a register plate, said register plate further characterized in that it is a feeder table capable of being pivoted in a downward direction and having: front stops and position sensors for detecting the printing marks of a sheet, said front stops capable of being lowered, a controller connected to the position sensors, ventilation openings, and vacuum feed lines connected to a suction apparatus; a first and second actuator, said first and second actuators for positioning the register plate in an X-direction; a third actuator for positioning in Y-direction; a register controller for controlling pivotal motion of the register plate, said pivotal motion including: downward pivoting of the register plate allowing passage of a gripper bar, a stoppage in motion, and pivoting the register plate in an upward direction once the gripper bar has passed; said insertion path characterized in that a sheet may be fed into the register insertion apparatus, stopped at the front stops until it is suctioned and fixed onto the register plate, advanced with the register plate in an X-direction, slid onto and gripped by the gripper bar, and transported by the gripper bar after ventilation of the register plate.

The dependent claims are related to advantageous further developments of the invention. These concern further improvements of the register functions and -characteristics and they enable a broader field of application and higher machine performance capacities. In the following, the invention is further explained on the basis of examples and Figures.

Figure 2:
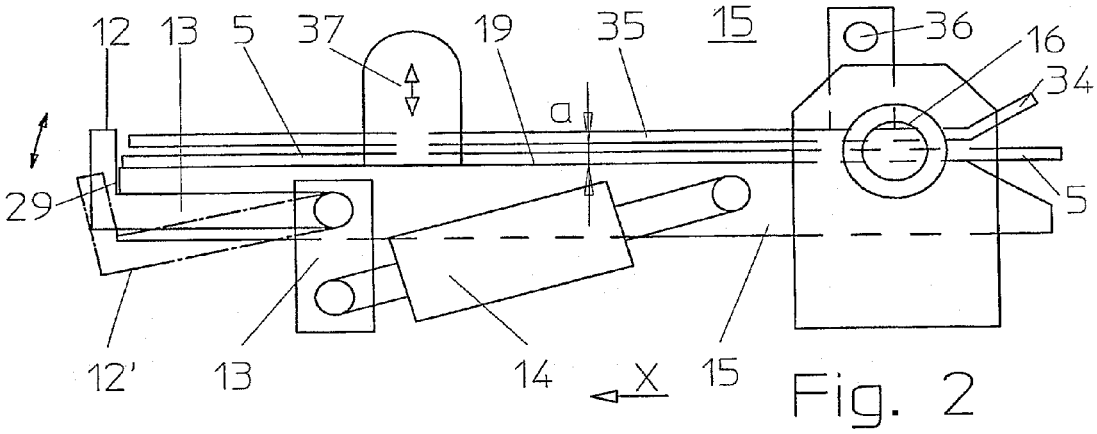
Figure 3:
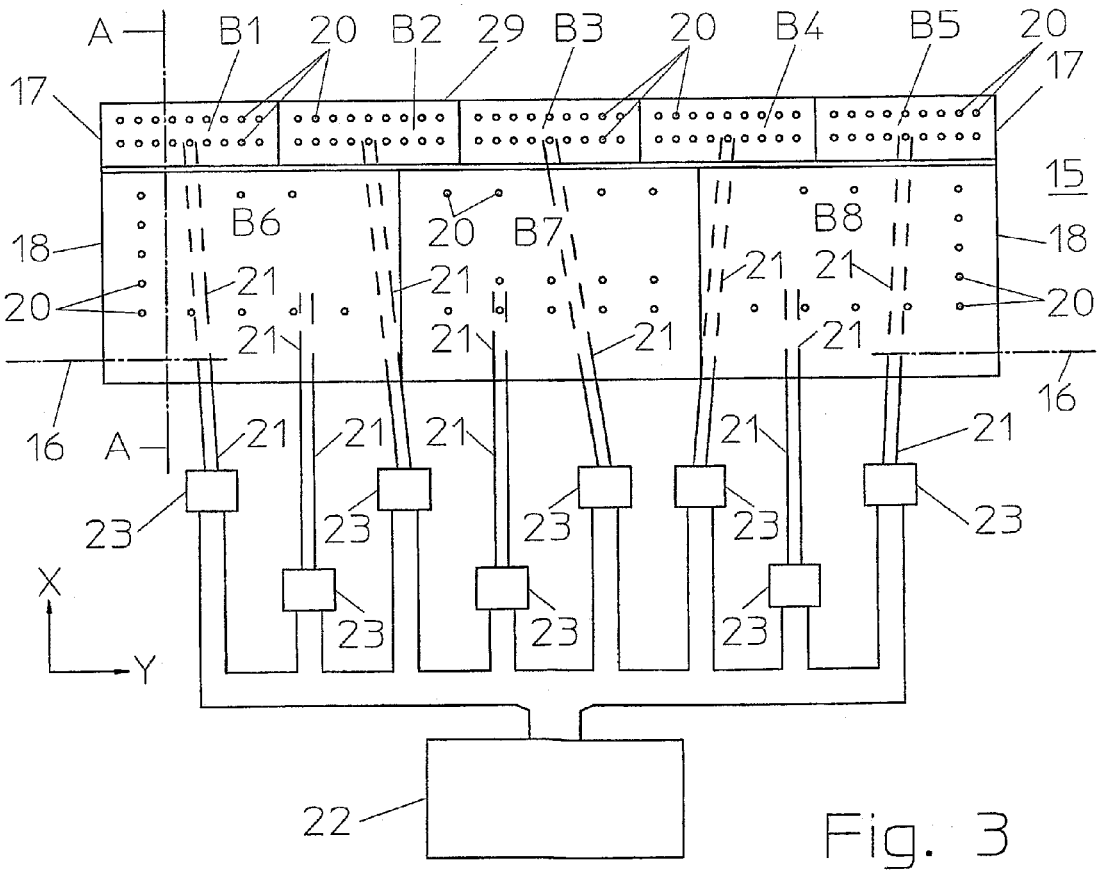
Figure 4:
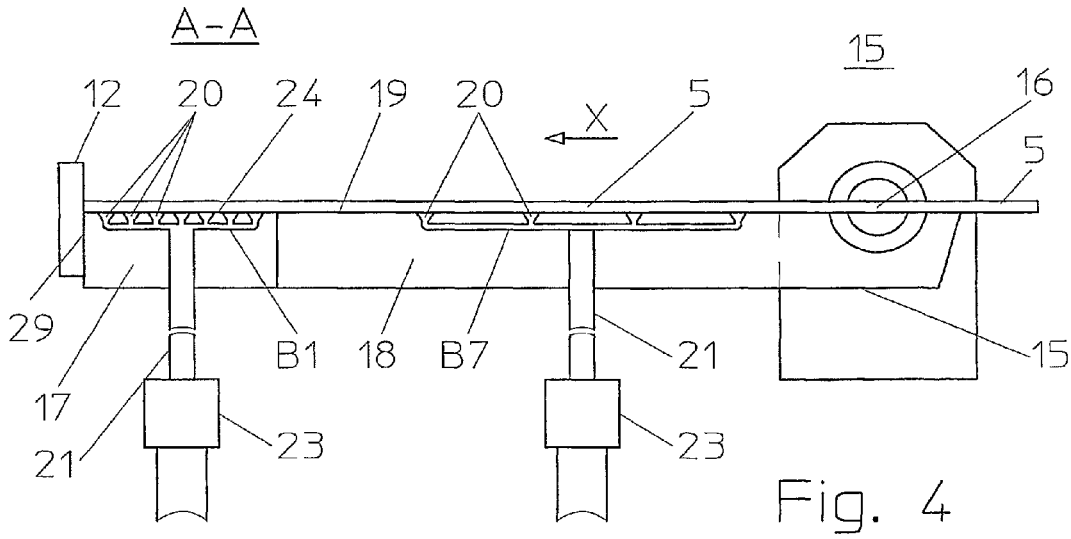
Figure 5A:
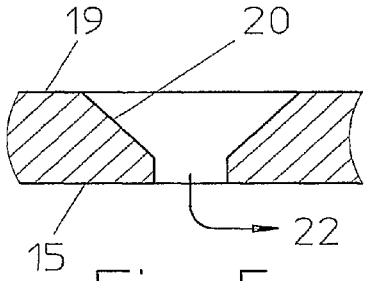
Figure 6:
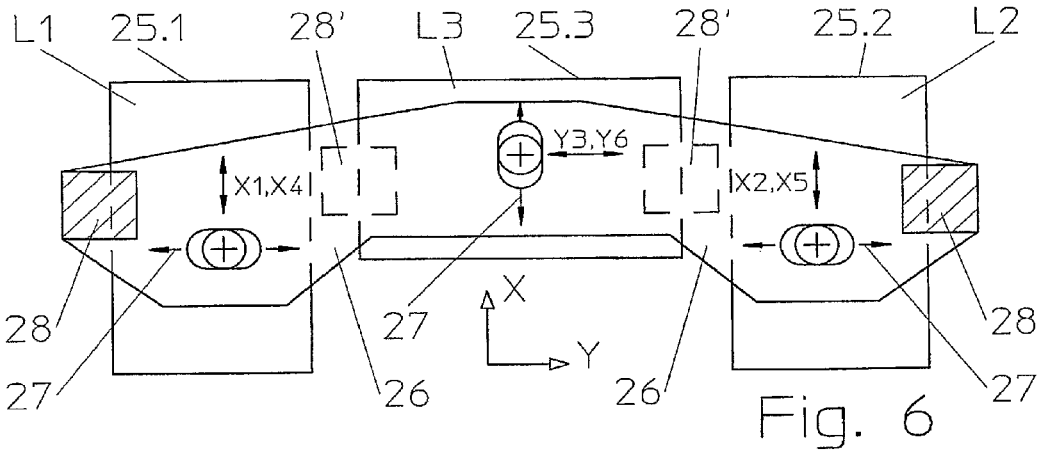
Figure 7A:
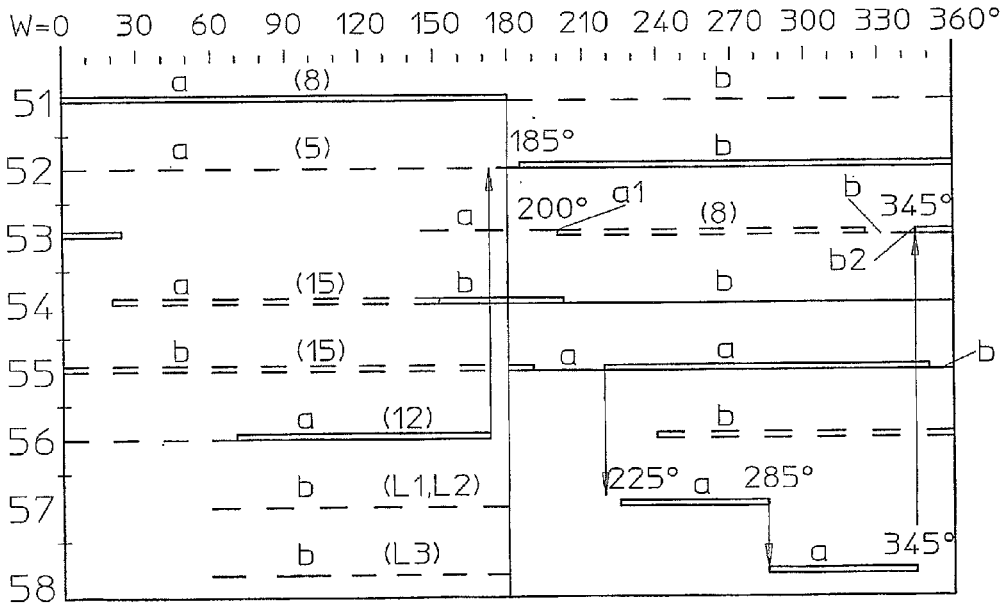
Figure 8:
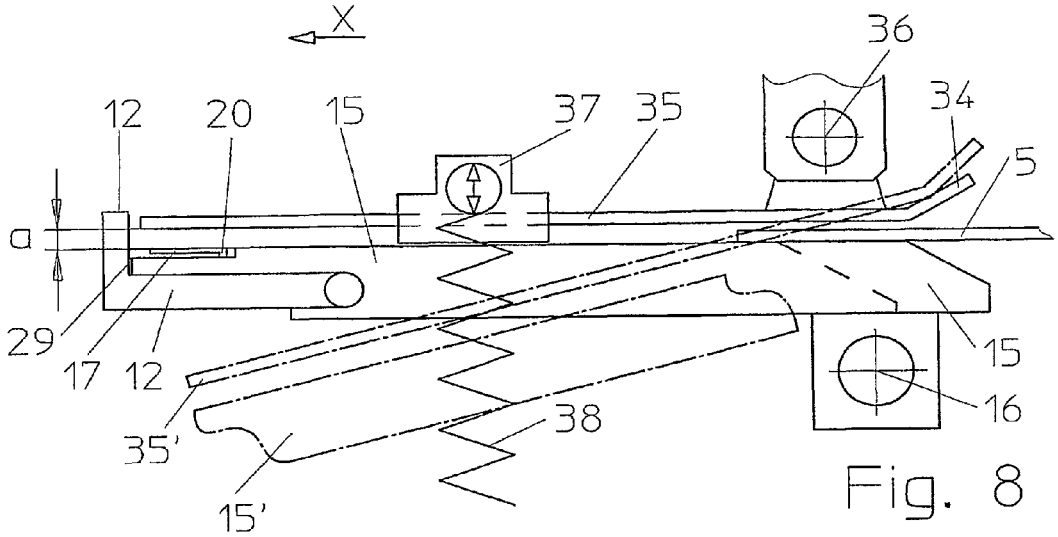
Figure 9:
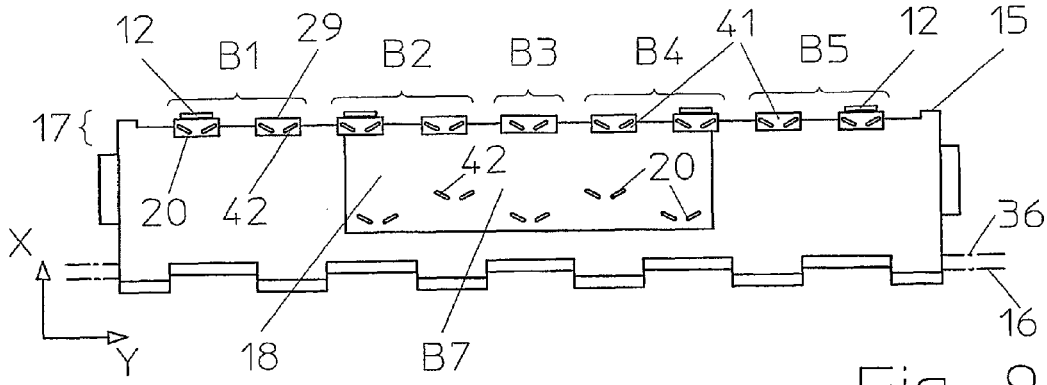
Figure 10:
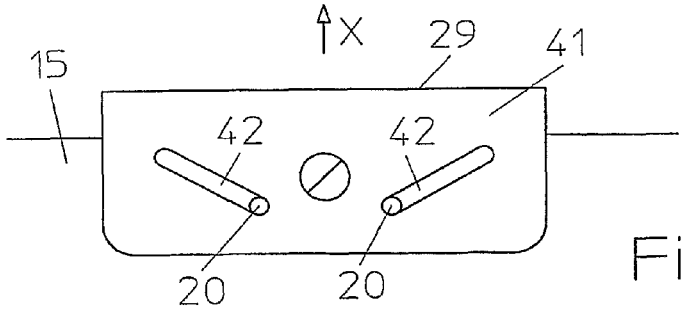
Figure 11:
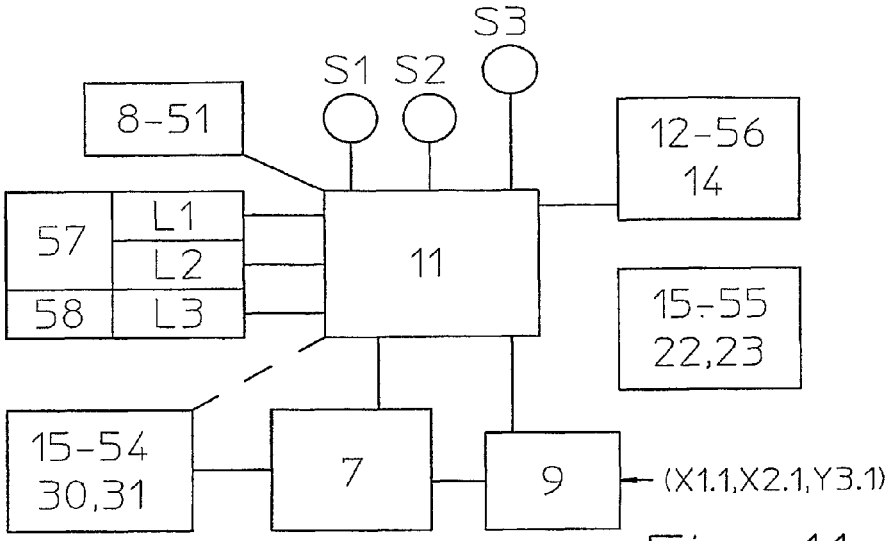
Figure 12:
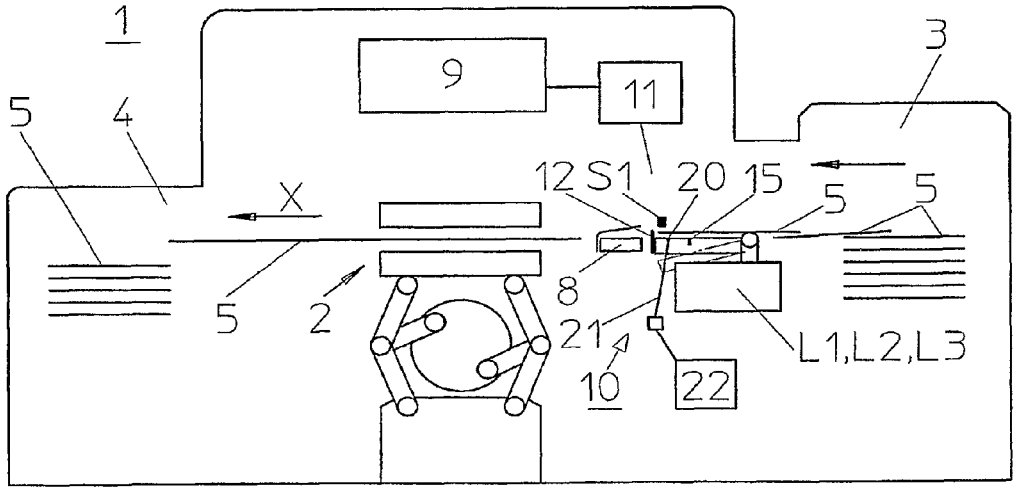

These illustrate:

FIG. 1 A register insertion apparatus according to the invention with a pivoting, movable register plate with ventilation openings and vacuum feed lines, FIG. 2 a register plate with pivoting front stops, FIG. 3 a register plate with ventilation openings in different suction areas and with a front suction bar in horizontal projection, FIG. 4 a register plate with ventilation openings in cross section, FIG. 5*a, b, c* examples of ventilation openings, FIG. 6 an arrangement of actuators with linear electric motors, a carrier plate with cross slide and supporting bearings for a register plate, FIG. 7*a, b* register diagrams with a course over time of the register functions over one machine cycle, FIG. 8 a register plate with a run-in plate, FIG. 9 a register plate with small suction plates, FIG. 10 a small suction plate, FIG. 11 schematically a register controller, FIG. 12 an embossing machine with a register insertion apparatus.

FIG. 1 shows a register insertion apparatus 10 for sheet-fed embossing machines with position sensors S1, S2, S3 for detecting printing marks P1, P2, P3 of a sheet 5, which define the front edge and the lateral edge of a print image, with a register plate 15 as feed table, which is capable of being pivoted down, with ventilation openings 20 and vacuum feed lines 21 to a suction device 22 and front stops 12, which are capable of being lowered, and with two actuators L1, L2 for positioning the register plate in X-direction and an actuator L3 for positioning in Y-direction and with a register controller 11 for controlling the register functions and components. The register plate 15 forms a feed table, resp., a support plate, on which the sheet 5 is supported for the transfer to the gripper bar 8.

In doing so, the register plate 15 is pivoted down 15' for the passage of a gripper bar 8, which is connected with a drive chain 32 of the embossing machine 1.

Figure 7B:
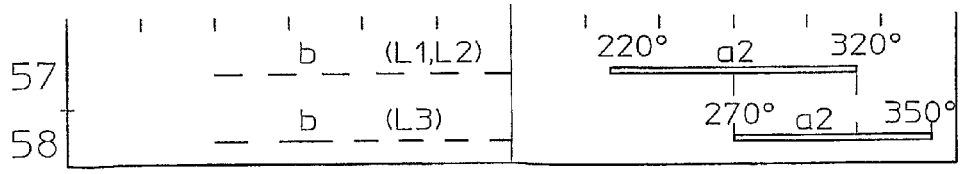

Thereupon the gripper bar is stopped and the register plate is pivoted up again and a sheet 5 is fed on to the register plate from a feeder 3 until it is stopped by the front stops 12. Then the register plate is evacuated for sucking and fixing the sheet 5 on the register plate 15. Subsequently the front stops 12 are lowered (12') and the register plate is moved in X-direction by the actuators L1, L2 and in doing so the sheet 5 is slid on to the gripper bar 8 and with this also the position of the printing marks P1, P2 on the sheet are detected with the sensors S1, S2 and from this a residual displacement X1, X2 is calculated and the register plate with the sheet is moved into the set position P1S, P2S in X-direction and after the position of the printing marks P1, P2 in X-direction is detected by the sensors S1, S2, the register plate is moved in Y-direction by the actuator L3 into the set position P3S, in that in an analogue manner the lateral edge printing mark P3 is detected by the sensor S3 and a lateral residual displacement Y3 is calculated. After the register alignment has been completed, the sheet 5 is gripped by the stationary gripper bar 8 by means of the gripper clamps being closed. Thereupon the register plate 15 is ventilated and as a result the sheet is released from the register plate, so that it is able to be transported on to the next station (here a flat-bed printing press 2) by the gripper bar 8 over the lowered front stops 12. As will be further explained by means of the FIGS. 7*a, b*, the register movements of the actuators in X-direction and in Y-direction are able to take place one after another (FIG. 7*a*) or they are able to partially take place simultaneously (FIG. 7*b*). For a precise register alignment, it is also possible that the sensor S3 is positioned close to the front edge of the register plate (S3').

In preference, the register plate 15 is capable of being pivoted down around a pivot axis 16 and moved by a machine drive 30, here, e.g., by means of a radial cam disc 31. This results in a simple, highly dynamic and precise driving of the register plate 15, synchronous with the machine running.

FIG. 1 further illustrates two front position sensors S1, S2, which are attached to a fixed frame above the register plate 15 and are adjustable. In preference, these are arranged at a short distance d of, e.g., 1-3 mm in front of the front printing marks P1, P2, when the sheet 5 is stationary (when it has arrived at the front stops 12). Thereupon the position of the printing marks P1, P2 is rapidly detected when the register plate is advanced and there is more time for the calculation of the residual displacements X1, X2 by the controller 11, so that the register plate 15 is able to be directly run to the desired set-positions P1S, P2S with overall displacements X4, X5 and the movement of the actuator L3 in Y-direction is able to start sooner. Analogue to this, it is directly run to the set position P3S in transverse direction with an overall displacement Y6.

In X-direction the overall displacement X0 (without register correction), e.g., amounts to 9 mm and it may be within a range of, e.g., 5-12 mm In Y-direction the basic displacement Y0 is able to be within a range of, e.g. 4-8 mm and amount to, e.g., 5 mm The overall displacements=basic displacement+calculated residual displacement then are:

$$X4=X0+X1,\ X5=X0+X2,\ Y6=Y0+Y3$$

It is also possible to enter additional picture-print correction values X1.1, X2.1, Y3.1 into the register controller 11 by hand. Then the overall displacements result as:

$$X4=X0+X1+X1.1,\ X5=X0+X2+X2.1,\ Y6=Y0+Y3+Y3.1.$$

Correction values of this kind, e.g., may serve to determine differences between an existing picture and a subsequent relief print, which has been applied to the existing picture by eye and to enter corresponding correction values, until reconciliation has been achieved.

The register positioning is also capable of being applied to sheets, which do not have any printing marks P1, P2, P3. Then the front and a lateral sheet edge serve as printing marks, which are detected by the correspondingly adjusted position sensors S1, S2, S3.

FIG. 2, for example, shows a register plate 15 with a simple version of the lowerable front stops 12, which are fixed to a holder 13 and are capable of being pivoted around an axis. The holder is rapidly moved on each side respectively by a pneumatic cylinder 14, i.e., pivoted up and down (12').

In order to achieve high machine speeds and a secure and precise functioning of the register device, the sheet 5 has to be fixed rapidly and without any distortion on the register plate 15, which as a whole is capable of carrying out the register positioning in X- and Y-direction rapidly and precisely, so that the sheet can be transferred to the gripper bar 8 precisely defined in the desired position. For this purpose, the fixing and releasing again of the sheet by means of suction and ventilation has to take place rapidly, in order that as much time as possible is available for the register positioning. With the register insertion apparatus according to the invention, therefore a rapid sucking and fixing of the sheet and a secure adhesion on the register plate 15 (without sliding) is achieved: On the one hand by means of a corresponding construction of the evacuation system with little void volume and a rapid actuation and by means of the arranging and dimensioning of the ventilation openings 20 and supply lines 21 and on the other hand by means of an optimum static friction on the surface 19 of the register plate. The function of a run-in plate 35 with a fixed pivot axis 36 and sliding stones 37 for guiding a sheet 5 running in close to the register plate 15 is further explained with the example of FIG. 8.

The FIGS. 3 to 5 illustrate examples of register plates 15 with ventilation openings 20, vacuum feed lines 21, valves 23 and suction device, resp., vacuum devices 22 for the rapid and secure fixing of the sheets 5 on the register plate. For this purpose, their surface 19 locally in the surrounding area of ventilation openings 20 is provided with a good static friction.

FIG. 3 in horizontal projection shows a register plate 15 with different suction areas Bi and with a front suction bar 17, on which the front edge of a sheet 5 is lying. Here the sheet on the suction bar in the most forward area 17 is particularly well fixed by means of an increased suction power on the suction bar 17 in comparison with the suction power, resp., to the pressure and the static friction force on the rear suction plate 18.

For this purpose, the register plate comprises suction areas B1, B2, . . . with differing, adjustable suction powers and/or with separate vacuum feed lines 21. It is possible that the suction areas differ by:

- The number and the arrangement of the ventilation openings 20 (many on the suction bar 17, relatively few on the suction plate 18) and by
- sub-division into individual chambers, each of which respectively being connected with a vacuum feed line 21 and a valve 23: Here the areas B1 to B5 on the suction bar 17 and B6 to B8 on the suction plate 18.

In doing so, e.g., the areas B1 to B5 and B7 are capable of being ventilated and evacuated and the areas B6 and B8 remaining open (not being evacuated), so that the sheet 5 above all in the most forward area 17 at the front edge 29 is fixed particularly well, rapidly and securely.

FIG. 4 illustrates the register plate 15 of FIG. 3 in the cross section A-A. In the most forward area 17 here the chamber of the area B1 is shows with a separate feed line 21 and a valve 23 and in the rear suction plate 18 the chamber of the area B6 with a separate feed line 21 and a valve 23. In the vacuum apparatus 22 with a vacuum reservoir, e.g., a vacuum of −0.6 bar is produced.

The surface 19 of the register plate around the ventilation openings 20 partially comprises an increased static friction, for example, it may be roughened or consist of eloxided aluminium. Above all in the most forward area 17, e.g., on a front suction bar, an increased static friction is strived for. For this purpose, it is also possible that here the suction bar 17 is covered with a layer of rubber 24 (e.g., 0.5 mm rubber coating).

Figure 5B:
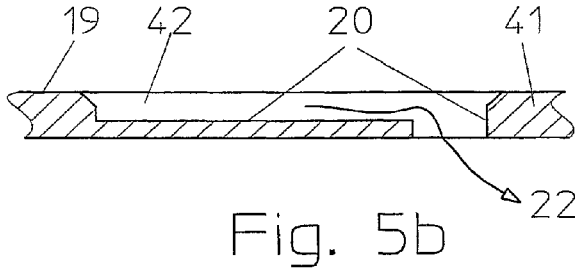
Figure 5C:
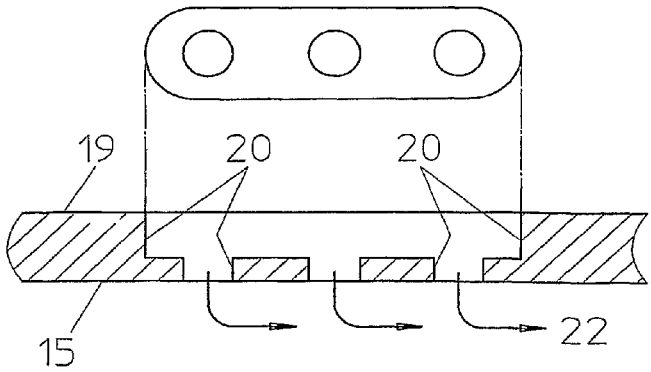

The FIGS. 5*a, b, c* illustrate examples of ventilation openings 20, which are widened towards the surface 19 of the register plate. The surface of the ventilation openings on top at the surface is larger (e.g., with a diameter=3 mm) than on the side of the vacuum feed lines 21 (e.g., with a diameter=1 mm) FIG. 5*b* shows a cross section through a small suction plate 41 with a slanted slit 42, which is shown in FIG. 8. FIG. 5*c* illustrates a vacuum opening 20, which on top is designed as slit-shaped (e.g., 3×12 mm) and at the bottom comprises three smaller openings (1 mm) With this, the pressure surface and also the pressure force at the register plate 15 is increased and the sheet fixing is better.

In order to be able to align the register plate 15 rapidly and accurately, highly dynamic, precise actuators L1, L2, L3 are utilised, e.g., servomotors with spindles. In doing so, the moving masses of the register plate 15 with its driving device are kept as low as possible, e.g., also by means of an aluminium construction. Advantageously, for this purpose linear motors may be utilised as actuators.

FIG. 6 illustrates, as is also shown FIG. 1, a lightweight, highly dynamic and precise driving device of the register plate 15, which comprises linear motors 25, a supporting plate 26 with linear guides 27 and pivot bearings, which form a cross slide, and with two external supporting bearings 28 for a pivot axis 16 of the register plate 15. In doing so, two linear motors 25.1, 25.2 run in X-direction and one linear motor 25.3 runs in Y-direction. The supporting bearings 28' may also be offset towards the inside and as a result of this make for a more compact, lighter construction.

The FIGS. 7*a*, 7*b* shows a register diagram with a course over time of the register functions through a machine cycle of 360° in function of the machine rotation angle W=0°-360° with the functions, resp., movements 51 to 58 of the components:

| | | |
|---|---|---|
| 51 | Movement of the driving chain 32 and gripper bar 8: | |
| | a = advance | b = stand still |
| 52 | Movement of the sheet 5: | |
| | a = transport, advance to the next station | |
| | b = fixed to the register plate 15 | |
| 53 | On the gripper bar 8: | |
| | a = open clamp | a1 = opening point |
| | b = close clamp | b2 = closing point |
| 54 | Register plate 15: | |
| | a = lower | b = lift |
| 55 | Register plate 15: | |
| | a = evacuate | b = ventilate |
| 56 | Front stops 12: | |
| | a = raise, raised | |
| | b = lower, lowered | |
| 57 | Longitudinal register in X-direction with actuators L1, L2: | |
| | a = move to the desired set-positions P1S, P2S | |
| | b = return to the position of departure | |
| 58 | Transverse register in Y-direction with actuator L3: | |
| | a = move to the desired set-position P3S | |
| | b = return to the position of departure | |
| 57a, 58a = 57a2, 58a2 | move the register plate 15 with the sheet 5 fixed on it the displacements in X-direction and in Y-direction partially take place simultaneously | |

The course over time of the register alignment according to FIG. 7*a*, for example, may be as follows:

The sheet 5 running on to the register plate 15 is mechanically stopped by the front stops 12, which are attached to the register plate. The sheet reaches the front stop, e.g., at W=185° of the machine position. The register plate at this point in time is approx. 8-10 mm before the theoretical end position (sheet transfer to the gripper bar). Immediately after the sheet arrival time, the register plate is evacuated and the sheet is sucked to the register plate with a vacuum. This produces a non-positive connection between the sheet and the register plate. Subsequently, at the point in time W=225° the actuators L1, L2 commence with their movement in the sheet running direction X. There are two printing marks P1, P2 and a lateral mark P3 on the sheet. The front mark reader, resp., the sensors S1, S2, which are situated at a distance of approx. 10 mm above the sheet, detect the passing printing marks P1, P2. In the register controller 11 the longitudinal mark signals are evaluated and with the two actuators L1, L2 the sheet is aligned in longitudinal direction X. For the complete displacement in X- and subsequently also in Y-direction the actuators have respectively 60° of the machine movement at their disposal. In case of a machine speed of, e.g., 7500 sheets/hour therefore respectively 80 ms for the X- and the Y-positioning result. As soon as the sheet at the front stop has been gripped by the vacuum of the register plate 15 and fixed, the front stop 12 is able to be pivoted down. The starting point for this is at W=240°. The front stop imperatively has to be in raised position again prior to the arrival of the sheet at the front stop at W=185°, e.g., at W=170°-180°. At the machine position W=285° the actuator L3 starts its movement. By means of a lateral mark reader, resp., sensor S3 and by the controller the sheet is laterally aligned in Y-direction. At the point in time W=345° the clamps on the gripper bar close and thus fix the sheet. Subsequently the register plate 15 is ventilated and at the point in time W=360° the sheet must be free for the further transportation by means of the gripper bar 8. In the example of FIG. 7*a* the movements in X-direction (57*a*) of 225°-285° and in Y-direction (58*a*) of 285°-345° take place one after the other.

FIG. 7*b* illustrates an example, in the case of which the displacements X4, X5 by the actuators L1, L2 in X-direction and the displacement Y6 by the actuator L3 in Y-direction partially take place at the same time, overlapping one another. Here the X-displacement (57*a*2), e.g., from W=220°-320° (over 100°) and the Y-displacement (58*a*2), e.g., from 270°-350° (over 80°) take place, wherein the displacements from W=270°-320° take place simultaneously.

Because of this, for each displacement direction X, Y correspondingly more time is available, resp., it is possible to achieve higher machine speeds.

The Y-displacement should only commence, when the position of the printing marks P1, P2 in X-direction has been detected. So that this happens rapidly, the sensors S1, S2 are arranged to be as close as possible to the printing marks P1, P2, e.g., at a distance of 1-3 mm, in preference 1-2 mm Preferably the Y-printing mark P3 should be read by the sensor S3 only when the X-displacements have been practically completed.

The displacements in X- and in Y-direction may also take place at the same time, e.g., in that the sensors 51, S2, S3 detect the printing marks P1, P2, P3 after the standstill of the sheet on the register plate at the same point in time, in that respectively as picture detection the position of a printing mark relative to a fixed reference point on the register plate 15 is detected, from this the residual displacements X1, X2, Y3 are calculated and then the actuators L1, L2, L3 simultaneously move the sheet in X- and in Y-direction into the desired positions P1S, P2S, P3S.

In order to further increase the machine speed, it is possible that the movement 51*a* of the driving chain 32 also amounts to more than 180°, e.g., 190°-200°, so that the standstill 51*b* would amount to less, 170°-160° and the further functions 52-58 would be correspondingly adapted.

The FIGS. 8 and 9 illustrate a further advantageous embodiment of a register plate with screwed on small suction plates according to FIG. 10.

The side view of the register plate 15 according to FIG. 8 shows a run-in plate 35 capable of being pivoted down as a guide plate for a sheet 5 running in, which by the run-in plate is conducted to the register plate close and flat, so that the sheet does not arch up and so that it is able to be sucked on rapidly. For this purpose, with sliding blocks 37, which lie on the register plate on both sides and with springs 38 it can be pushed against the register plate 15 and a small distance a between the register plate 15 and the inlet plate 35 can be set. This distance a of, e.g., 1-2 mm is adjusted in such a manner, that the sheet is able to run in with as little friction as possible and nonetheless lies on the register plate completely flat. The run-in plate 35 at the sheet inlet comprises an upward arching 34 and a fixed pivot axis 36, which is fixed to the chassis. By means of this, the run-in plate is capable of being pivoted down with the register plate (15', 35') and the sheet running in already at the beginning can be guided close to a still pivoted down register plate.

FIG. 9 illustrates the register plate of FIG. 8 viewed from above with small suction plates 41 in the most forward area 17 along the front edge 29 of the register plate. For an optimum adhesion and register alignment of the sheets 5, in preference at least in this most forward area 17 ventilation openings 20 are arranged. This most forward area 17 preferably also comprises a higher suction performance capacity (here by means of a greater number of ventilation openings 20) than the area of the register plate situated behind it (18 in FIG. 3), which here comprises only few ventilation openings 20 in a middle suction area B7.

FIG. 10 shows one of the small suction plates 41 of FIG. 9, which can be manufactured in an economic manner, of being screwed on to the register plate on the front edge 29 in a simple way and which are also exchangeable. The small suction plates 41 comprise slanted slits 42 with a small angle to the transverse axis Y of, e.g., 30°, so that sheets running in do not bump against these. For the optimum fixing of the sheets on the register plate, these front suction plates 41 comprise a rubber coating on the surface 19 (FIG. 5*b*). In the rear suction area B7 no rubber coating is provided here.

Briefly summarised, the sheets 5 shall run-in easily, rapidly and flat right up to the front stops and then, above all in the most forward area 17 shall be rapidly and securely fixed to the register plate by evacuation, so that the register alignment can be carried out rapidly and precisely—without any slipping or arching of the sheets 5.

FIG. 11 schematically illustrates a register controller 11, which is connected with the position sensors S1, S2, S3, the actuators L1, L2, L3, the actuating means 30, 31 of the register plate 15 and the suction apparatus 22 with the valves 23 and with a drive 14 of the front stops 12 as well as with a machine control 7 of an assigned embossing machine. The register controller also comprises a control program with a computer. An operating- and display device 9 enables, e.g., also the entering of additional correction values X1.1, X2.1, Y3.1. With the register controller the execution of the different functions 51-58 takes place as it is described for FIG. 7. With the register insertion apparatus 10 according to the invention and its register controller 11 it is possible to also brake, resp., slow down a sheet 5 running in through a conveying device of a feeder 3 shortly before its arrival at the front stops 12, in order to reduce the deceleration of the sheet when bumping against the stops.

FIG. 12 illustrates an embossing machine 1 with a register insertion apparatus 10 according to the invention with an evacuatable register plate 15, a register controller 11 and an operating- and display device 9 as well as with a flat bed press 2 and a delivery means 4. Sheets 5 are conducted to the register plate 15 from a feeder unit 3 in a scale-like stream. The width of the register plate 15 in X-direction is smaller than the scale spacing.

Within the scope of this description, the following designations are utilised:

1 Embossing machine
2 Flat bed press
3 Feeder
4 Delivery means
5 Sheet
7 Machine control
8 Gripper bar
9 Operating and display device
10 Register insertion apparatus, register draw-in device
11 Register controller
12 Front stops
13 Holder of 12
14 Pneumatic cylinder
15 Register plate, feed table, supporting plate
16 Pivot axis of 15
17 Most forward area on 29, suction bar
18 Rear suction plate
19 Surface of 15
20 Ventilation openings
21 Vacuum feed lines
22 Suction apparatus, vacuum device
23 Valves
24 Rubber coating
25 Linear electric motor
26 Supporting plate
27 Linear guides
28 Bearing of 16
29 Front edge of 15
30 Machine drive
31 Cam disc
32 Driving chain
34 Arching
35 Run-in plate, guide plate
36 Fixed pivot axis of 35
37 Sliding block
38 Spring
41 Small suction plates
42 Slanted slit
51-58 Functions of 10
P1, P2, P3 Printing marks
P1S, P2S, P3S Desired positions, set positions
S1, S2, S3 Position sensors
L1, L2, L3 Actuators
X Running direction
Y Transverse direction
X0, Y0 Basic displacement of 15
X1, X2, Y3 Calculated residual displacements, register correction values
X1.1, X2.1, Y3.1 Additional correction values
X4, X5, Y6 Total displacement of 15
W Machine rotation angle
d Distance between position S1, S2 and P1, P2
a Distance between 35 and 15
B1, B2, B3 Suction areas

The invention claimed is:

1. A register insertion apparatus for sheet embossing machines for use with a sheet having printing marks defining a front edge and a lateral edge of a print image, the sheet movable along an insertion path, said apparatus comprising:

a register plate, said register plate further characterized in that it is a feeder table capable of being pivoted in a downward direction and having:

front stops and position sensors for detecting the printing marks of a sheet, said front stops capable of being lowered, a controller connected to the position sensors, ventilation openings, and vacuum feed lines connected to a suction apparatus;

a first and second actuator, said first and second actuators for positioning the register plate in an X-direction;

a third actuator for positioning in Y-direction;

a register controller for controlling pivotal motion of the register plate, said pivotal motion including: downward pivoting of the register plate allowing passage of a gripper bar, a stoppage in motion, and pivoting the register plate-in an upward direction once the gripper bar has passed;

said insertion path characterized in that a sheet may be fed into the register insertion apparatus, stopped at the front stops until it is suctioned and fixed onto the register plate, advanced with the register plate in an X-direction, slid onto and gripped by the gripper bar, and transported by the gripper bar after ventilation of the register plate.

2. The register insertion apparatus according to claim 1, characterised in that the displacement in the X-direction and the displacement in the Y-direction partially take place simultaneously.

3. The register insertion apparatus according to claim 1, characterised in that the register plate is capable of being pivoted around a pivot axis and is moved by a machine drive.

4. The register insertion apparatus according to claim 1, characterised in that the front stops are fixed on a holder, which is capable of being pivoted up and—down by means of a pneumatic cylinder.

5. The register insertion apparatus according to claim 1, characterised in that the first, second, and third actuators are highly dynamic.

6. The register insertion apparatus according to claim 5, further characterised in that the highly dynamic actuators are linear electric motors.

7. The register insertion apparatus according to claim 5, further characterised in that the highly dynamic actuators are servo-motors with spindles.

8. The register insertion apparatus according to claim 1, characterised in that the first, second, and third actuators comprise three linear electric motors and a supporting plate with linear guides and with two bearings for a pivot axis of the register plate.

9. The register insertion apparatus according to claim 1, characterised in that the register plate comprises a run-in plate, which is capable of being pivoted down.

10. The register insertion apparatus according to claim 9, characterised in that the run-in plate comprises a fixed pivot axis on a chassis and spring loaded sliding blocks, with which a small adjustable distance between the register plate and the run-in plate is defined.

11. The register insertion apparatus according to claim 1, characterised in that the register plate has a most forward area and a less forward area, said less forward area being an area of the register plate positioned closer to a register plate pivot axis, said most forward area being an area of the register plate positioned furtherest away from the register plate pivot axis, said most forward area having a front edge, and at least in the most forward area of the register plate comprising ventilation openings on its front edge.

12. The register insertion apparatus according to claim 1, characterised in that the register plate comprises suction areas with differing, adjustable suction powers or with separate vacuum feed lines.

13. The register insertion apparatus according to claim 1, characterised in that it has a most forward area and a less forward area, said less forward area being an area of the register plate positioned closer to a register plate pivot axis, said most forward area being an area of the register plate positioned furtherest away from the register plate pivot axis, and where in the most forward area of the register plate a higher suction power is provided.

14. The register insertion apparatus according to claim 1, further characterized in that the register plate has a most forward area and a less forward area, said less forward area being an area of the register plate positioned closer to a register plate pivot axis, said most forward area being an area of the register plate positioned furtherest away from the register plate pivot axis, said most forward area having a front edge, and said front edge of the register plate having small suction plates with slanted slits attached as ventilation openings.

15. The register insertion apparatus according to claim 1, wherein the registration plate has a surface and further characterised in that the ventilation openings are widened towards the surface of the register plate.

16. The register insertion apparatus according to claim 1, wherein the registration plate has a surface and further characterised in that the surface of the register plate in the area of ventilation openings comprises an enhanced static friction.

17. The register insertion apparatus according to claim 16, further characterized in that the register plate has a most forward area and a less forward area, said less forward area being an area of the register plate positioned closer to a register plate pivot axis, said most forward area being an area of the register plate positioned furtherest away from the register plate pivot axis, and further characterised in that the surface at least in the most forward area of the register plate comprises a rubber coating.

18. The register insertion apparatus according to claim 1, characterised in that additional picture—print correction values are capable of being entered into the register controller.

19. The register insertion apparatus according to claim 1, characterised in that the register controller is connected with the position sensors, the actuators, the register plate, the suction apparatus and with a drive of the front stops and further comprises a control program.

20. The register insertion apparatus according to claim 1, characterised in that the front position sensors are arranged at a distance of 1-3 mm in front of the front printing marks when the sheet is standing still.

21. The register insertion apparatus of claim 1 further comprising an operating and display device.

22. A method for use with a register insertion apparatus for sheet embossing machines, said method utilizing a sheet having printing marks defining a front edge and a lateral edge of a print image, the method comprising the steps of:

positioning a register plate in an X-direction with first and second actuators, said register plate as a feeder table capable of being pivoted down and comprising ventilation openings and vacuum feed lines connected to a suction apparatus;

positioning the register plate in a Y-direction with a third actuator;

pivoting the register plate in a downward direction with a register controller, allowing the passage of a gripper bar;

stopping the gripper bar upon the register plate;

pivoting the register plate in an upward direction;

feeding the sheet into the register insertion apparatus and on to the register plate until it is stopped by front stops, said front stops in a raised position and capable of being lowered;

evacuating the register plate with the ventilation openings and vacuum feed lines connected to the suction apparatus, causing the sheet to be sucked on to and fixed upon the register plate;

lowering the front stops;

advancing the register plate in an X-direction with the first and second actuators;

sliding the sheet on to the gripper bar;

detecting the position of the printing marks with the position sensors;

calculating a residual displacement value;

moving the register plate with the sheet in an X-direction to a desired position based on the residual displacement value calculation;

moving the register plate in a Y-direction by the third actuator;

gripping the sheet with the gripping bar;

ventilating the register plate; and transporting the sheet on with the gripper bar.

23. The method of claim 22, further characterised in that the sheet is braked by a feeder device of a feeder shortly before its arrival at the front stops.

24. The method of claim 22, further characterised in that the positioning of the register is aligned to the front edge of the sheet and to the lateral edge of the sheet instead of to the printing marks.

25. The method of claim 22, further characterised in that the displacement in X-direction and the displacement in Y-direction partially take place simultaneously.

26. The method of claim 22, further characterised in that additional picture—print correction values are capable of being entered into the register controller.

27. The method of claim 22, further characterised in that the front position sensors are arranged at a distance of 1-3 mm in front of the front printing marks when the sheet is standing still.

* * * * *